US005734952A

United States Patent [19]

Murakami et al.

[11] Patent Number: 5,734,952

[45] Date of Patent: Mar. 31, 1998

[54] DEVELOPING DEVICE FOR AN IMAGE FORMING APPARATUS AND TONER CARTRIDGE FOR REPLENISHING A FRESH TONER TO THE DEVELOPING DEVICE

[75] Inventors: Eisaku Murakami, Hiratsuka; Hiroshi Saitoh, Ayase, both of Japan

[73] Assignee: Ricoh Company, Ltd., Tokyo, Japan

[21] Appl. No.: 602,043

[22] Filed: Feb. 15, 1996

[30] Foreign Application Priority Data

| | | | |
|---|---|---|---|
| Feb. 16, 1995 | [JP] | Japan | 7-028074 |
| Mar. 23, 1995 | [JP] | Japan | 7-091856 |
| Apr. 28, 1995 | [JP] | Japan | 7-106516 |

[51] Int. Cl.[6] ..... G03G 15/08

[52] U.S. Cl. ..... 399/255; 399/256; 399/258; 399/260; 399/262

[58] Field of Search ..... 399/253–260, 399/262, 119; 222/DIG. 1

[56] References Cited

U.S. PATENT DOCUMENTS

| | | | |
|---|---|---|---|
| 4,254,202 | 3/1981 | Matsumoto et al. . | |
| 4,470,694 | 9/1984 | Murakami et al. . | |
| 4,518,248 | 5/1985 | Nishikawa . | |
| 4,888,620 | 12/1989 | Fujino et al. . | |
| 4,985,734 | 1/1991 | Honda et al. . | |
| 4,987,446 | 1/1991 | Machimaru et al. . | |
| 5,012,289 | 4/1991 | Aldrich et al. | 399/260 |
| 5,126,799 | 6/1992 | Matsuura . | |
| 5,204,720 | 4/1993 | Ishida et al. . | |
| 5,268,720 | 12/1993 | Saitoh et al. . | |
| 5,298,952 | 3/1994 | Kamijo et al. . | |
| 5,315,357 | 5/1994 | Kamijo et al. . | |
| 5,331,377 | 7/1994 | Matsuura et al. . | |
| 5,349,425 | 9/1994 | Kamijo et al. . | |
| 5,363,177 | 11/1994 | Nakano et al. . | |
| 5,475,479 | 12/1995 | Hatakeyama et al. . | |
| 5,489,747 | 2/1996 | Takenaka et al. . | |
| 5,510,883 | 4/1996 | Kimura et al. | 399/256 |

FOREIGN PATENT DOCUMENTS

| | | |
|---|---|---|
| 44 22 635 A1 | 1/1981 | Germany . |
| 30 05 455 A1 | 8/1981 | Germany . |
| 30 08 559 A1 | 9/1981 | Germany . |
| 39 41 506 | 6/1990 | Germany . |
| 42 23 147 | 1/1993 | Germany . |
| 56-69676 | 6/1981 | Japan . |
| 62-269189 | 11/1987 | Japan . |
| 63-56676 | 3/1988 | Japan . |
| 1-76074 | 3/1989 | Japan . |

*Primary Examiner*—William J. Royer
*Attorney, Agent, or Firm*—Oblon, Spivak, McClelland, Maier & Neustadt, P.C.

[57] ABSTRACT

A developing device for an electrophotographic image forming apparatus and a toner cartridge for replenishing a fresh toner to the developing device are disclosed. A toner is circulated between a toner cartridge and a hopper so that an additive included in the toner existing in the developing device is adequately distributed throughout the developing device. This prevents the concentration of additive in the toner from differing at the ends of the hopper with respect to the center of the hopper. This ensures that images are produced with constant toner density.

40 Claims, 9 Drawing Sheets

DEVELOPING DEVICE FOR AN IMAGE FORMING APPARATUS AND TONER CARTRIDGE FOR REPLENISHING A FRESH TONER TO THE DEVELOPING DEVICE

BACKGROUND OF THE INVENTION

The present invention relates to a developing device for an electrophotographic image forming apparatus, and a toner cartridge for replenishing a fresh toner to the developing device.

A copier, facsimile apparatus, laser printer or similar electrophotographic image forming apparatus has a developing device for developing a latent image electrostatically formed on a photoconductive element, or image carrier, by using a toner. It has been customary with this kind of apparatus to replenish a fresh toner into the developing device from a toner cartridge removably mounted to the developing device. The developing device includes a toner storing section or hopper for receiving the fresh toner from the cartridge. During the course of development, the toner is sequentially fed from the hopper to the photoconductive element. The toner consists of toner particles and an additive. The problem with the conventional developing device is that as the developing device is operated a number of times, the additive concentration of the toner increases. As a result, the toner density, i.e., the density of an image developed by the toner is lowered. Specifically, although the additive should ideally be transferred to the latent image of the photoconductive element together with the toner particles, the additive is, in practice, left in the hopper without being consumed. Moreover, assume that the developing device or the entire image forming apparatus is held in an inclined position by accident. Then, because the toner is fed over the entire length of the photoconductive element, the additive concentrates on one end portion lower in level than the other end portion. This further increases the additive concentration of the toner and thereby aggravates the decrease in toner density or image density.

SUMMARY OF THE INVENTION

It is therefore an object of the present invention to provide a developing device for an image forming apparatus and capable of preventing the toner density from decreasing, and a toner cartridge therefor.

In accordance with the present invention, a developing device for an image forming apparatus has a toner storing section for storing a single-ingredient type toner to be deposited on a latent image electrostatically formed on an image carrier. A toner cartridge is removably mounted to the body of the developing device, and stores a fresh toner to be replenished into the toner storing section. A circulating arrangement is provided for circulating the toner between the toner cartridge and the toner storing section.

Also, in accordance with the present invention, a developing device for an image forming apparatus has a toner storing section for storing a single-ingredient type toner to be deposited on a latent image electrostatically formed on an image carrier. An agitator agitates the toner existing in the toner storing section. A toner cartridge is removably mounted to the body of the developing device, and stores a fresh toner to be replenished into the toner storing section. The toner cartridge has toner outlets for replenishing the fresh toner, a conveying member for conveying the fresh toner to the toner outlets, collection openings for receiving the toner forced out by the agitator, and a collecting arrangement for conveying the toner received via the collection openings into the toner cartridge.

Further, in accordance with the present invention, a toner cartridge storing a fresh toner and removably mounted to the body of a developing device for replenishing the fresh toner into a toner storing section included in the developing device has toner outlets for replenishing the fresh toner. Collection openings receive a part of a toner existing in the toner storing section. A magnetic roller extends in the longitudinal direction of the body of the toner cartridge, and faces the toner outlets and collection openings. A blade contacts a portion of the magnetic roller facing the collection openings, and scrapes off the fresh toner and toner collected via the collection openings from the magnetic roller.

Furthermore, in accordance with the present invention, a developing device for an image forming apparatus has a toner storing section for storing a single-ingredient type toner. A conveying member causes the toner in the toner storing section to deposit on the surface thereof, and causes it to be transferred to a latent image electrostatically formed on an image carrier. A supply roller is rotatably disposed in the toner storing section for driving the toner in the toner storing section toward the conveying member. A coil member is fitted on the supply roller for shifting the toner in the axial direction of the supply roller. A movable member has a stationary end affixed to a predetermined position of the body of the developing device and free ends received between the nearby turns of the coil member. The free ends are movable up and down in association with the rotary motion of the supply roller.

Moreover, in accordance with the present invention, a developing device for an image forming apparatus has a toner storing section for storing a single-ingredient type toner. A conveying member causes the toner in the toner storing section to deposit thereon, and causes it to be transferred to a latent image electrostatically formed on an image carrier. A supply roller is rotatably disposed in the toner storing section for driving the toner in the toner storing section toward the conveying member while agitating it. A toner cartridge is removably mounted to the body of the developing device, and stores a fresh toner to be replenished into the toner storing section. The toner cartridge has toner outlets for replenishing the fresh toner, a conveying member for conveying the fresh toner to the toner outlets, collection openings for receiving the toner forced out by the supply roller, and a collecting arrangement for conveying the toner received via the collection openings into the toner cartridge. A coil member is fitted on the supply roller for shifting the toner in the axial direction of the supply roller. A movable member has a stationary end affixed to a predetermined position of the body of the developing device and free ends received between the nearby turns of the coil member. The free ends are movable up and down in association with the rotary motion of the supply roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
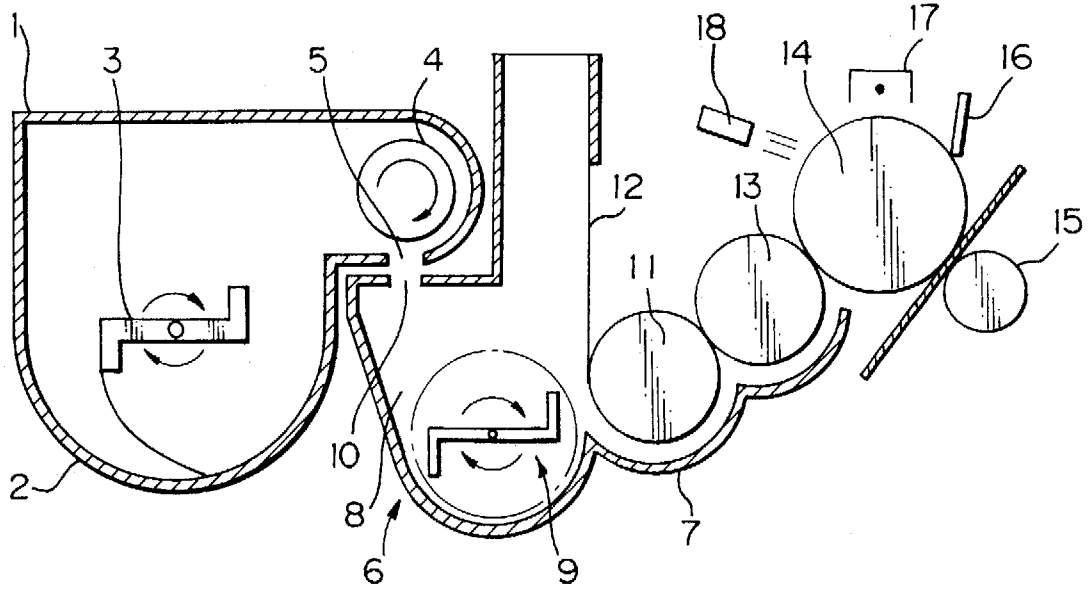
Fig. 1 PRIOR ART
FIG. 1 is a section of a conventional developing device operable with a toner cartridge.
Figure 2:
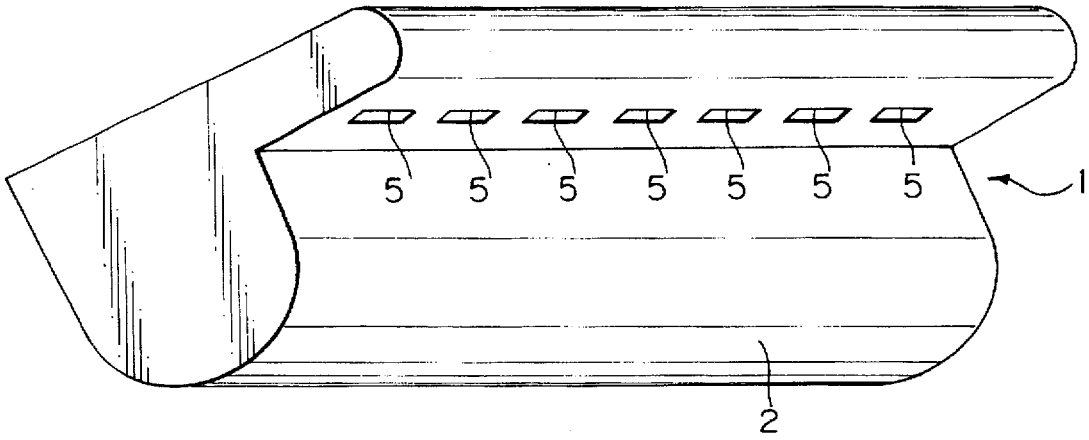
Fig. 2 PRIOR ART
FIG. 2 is an external perspective view of the toner cartridge shown in FIG. 1.

To better understand the present invention, a brief reference will be made to a conventional developing device using a toner cartridge, shown in FIG. 1. As shown, a toner cartridge 1 stores a fresh single-ingredient type toner therein. The cartridge 1 has a casing 2 accommodating an agitator 3 and a magnetic roller 4. The agitator 3 is rotated to agitate the toner existing in the casing 2. The casing 2 is formed with a plurality of toner outlets 5. As shown in FIG. 2, the toner outlets 5 are arranged in an array in the lengthwise direction of the casing 2.

A developing device 6 has a casing 7 including a toner storing section, or hopper as referred to hereinafter, 8. An agitator 9 is rotatable in the hopper 8 for agitating the toner existing in the hopper 8. A toner inlet 10 is formed in a portion of the casing 7 which faces the toner outlets 5 of the cartridge casing 2. A developing roller 11 causes the toner to deposit thereon. A doctor blade 12 causes the toner to form a thin layer on the surface of the developing roller 11. An intermediate roller 13 is held in contact with the developing roller 11, so that the toner is transferred from the roller 11 to the roller 13. A photoconductive element in the from of a drum 14 is held in contact with the intermediate roller 13. The toner is transferred from the roller 13 to the drum 14 in order to develop a latent image electrostatically formed on the drum 14. The resulting toner image is transferred from the drum 14 to a paper or similar recording medium by an image transfer unit 15. A cleaning unit 16 cleans the surface of the drum 14 after the image transfer. A charger 17 uniformly charges the surface of the drum 14. An exposing device 18 exposes the charged surface of the drum 14 imagewise so as to form the latent image.

The toner in the hopper 8 is conveyed toward the developing roller 11 while being agitated by the agitator 9. The toner deposited on the roller 11 is regulated by the doctor blade 12 to form a thin layer, while being frictionally charged thereby. As a result, the toner is electrically transferred from the roller 11 to the intermediate roller 13. On the other hand, the drum 14 is uniformly charged by the charger 17. The exposing device 18 electrostatically forms a latent image on the charged surface of the drum 14. When the latent image is conveyed by the drum 14 to a position where the drum 14 contacts the roller 13, the toner is transferred from the roller 13 to the latent image. The resulting toner image is transferred to the paper by the image transfer unit 15.

The magnetic roller 4 disposed in the cartridge 1 serves to replenish the fresh toner into the developing device 6. Hence, to insure stable replenishment into the hopper 8, it is preferable to use means for scraping off the toner from the surface of the roller 4, as will be described with reference to FIG. 3.

Figure 3:
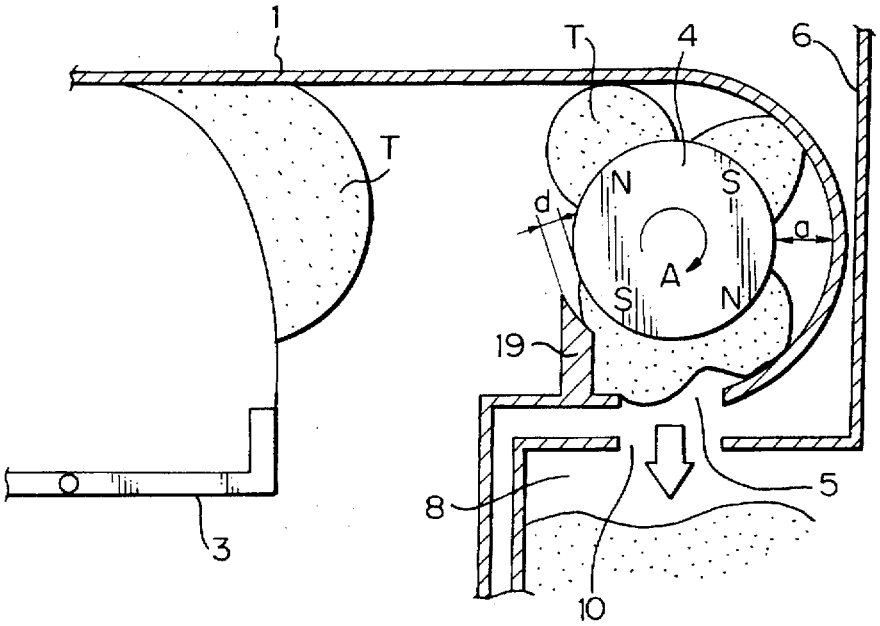
Fig. 3 PRIOR ART
FIG. 3 is a section showing an arrangement around a magnetic roller disposed in the toner cartridge shown in FIG. 2.

FIG. 3 shows an arrangement around the magnetic roller 4. As shown, an upright rib 19 extends in the lengthwise direction of the toner outlets 5 from the downstream edges of the outlets 5 with respect to the direction of toner conveyance. The edge of the rib 19 and the roller 4 are spaced from each other by a gap d. The agitator 3 rotating in the cartridge 1 conveys the toner, labeled T, to the roller 4. The toner deposited on the roller 4 is conveyed toward the toner outlets 5 by the roller 4 which is rotated in a direction A. Specifically, the toner T is deposited on the roller 4 over a clearance a between the roller 4 and the inner periphery of the cartridge casing 2. Because the gap d is selected to be smaller than the clearance a, the toner T deposited on the roller 4 is scraped off by the rib 19 and introduced into the hopper 8.

Figure 4:
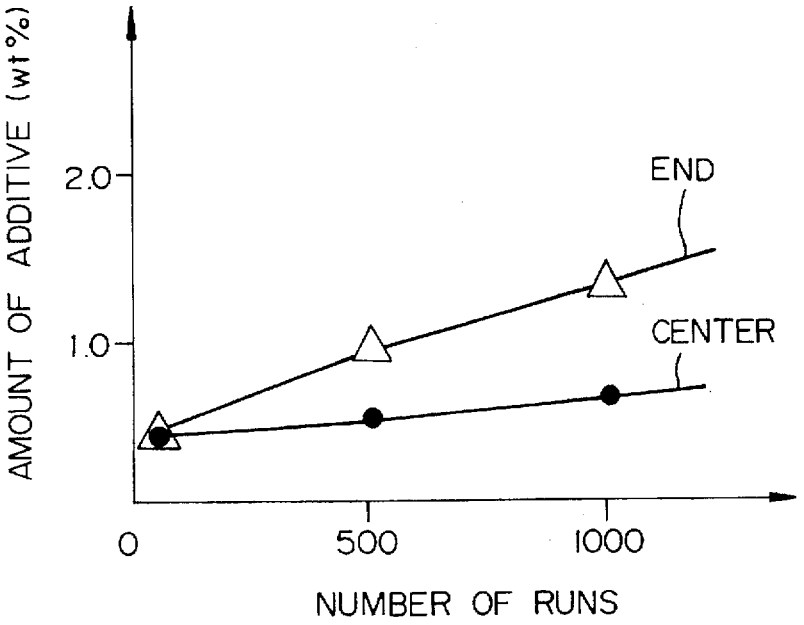
Fig. 4 PRIOR ART
FIG. 4 is a graph showing a relation between the number of runs of the developing device and the amount of an additive existing in a hopper included in the device.
Figure 5:
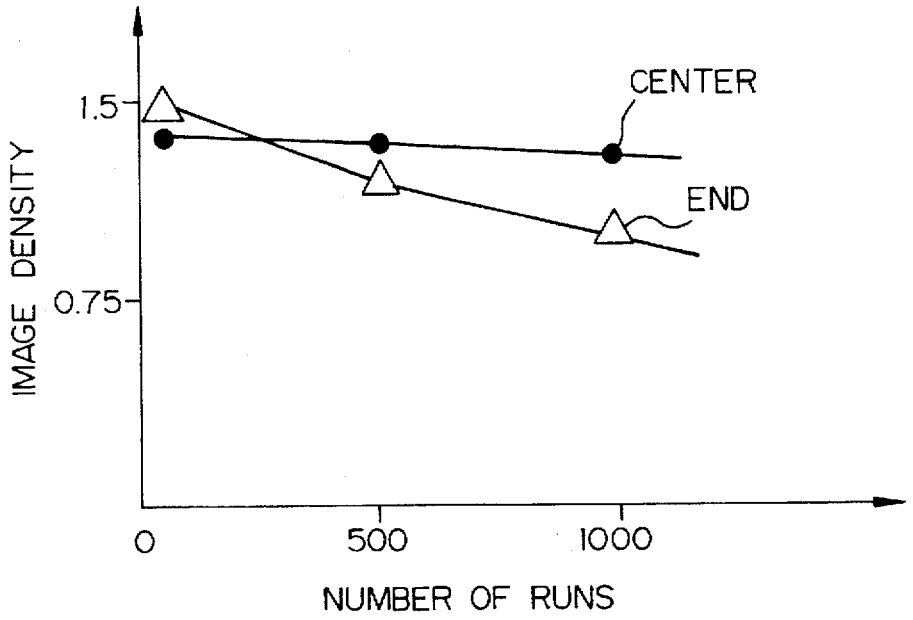
Fig. 5 PRIOR ART
FIG. 5 is a graph showing a relation between the number of runs of the developing device and the image density.

In the above configuration, the toner T is stably replenished from the cartridge 1 into the hopper 8 at all times. However, in the hopper 8, the concentration of an additive included in the toner sequentially increases with an increase in the number of runs of the developing device 6. As a result, the image density is lowered. Particularly, as shown in FIG. 4, the additive concentration of the toner noticeably increases at the end portions of the developing device 6, compared to the intermediate portion of the same. FIG. 5 shows the resulting decrease in image density.

Preferred embodiments of the present invention will be described hereinafter which are free from the problem discussed above. In the embodiments, the same or similar constituents as or to the constituents shown in FIGS. 1–3 are designated by the same reference numerals, and a detailed description thereof will not be made in order to avoid redundancy.

Figure 6:
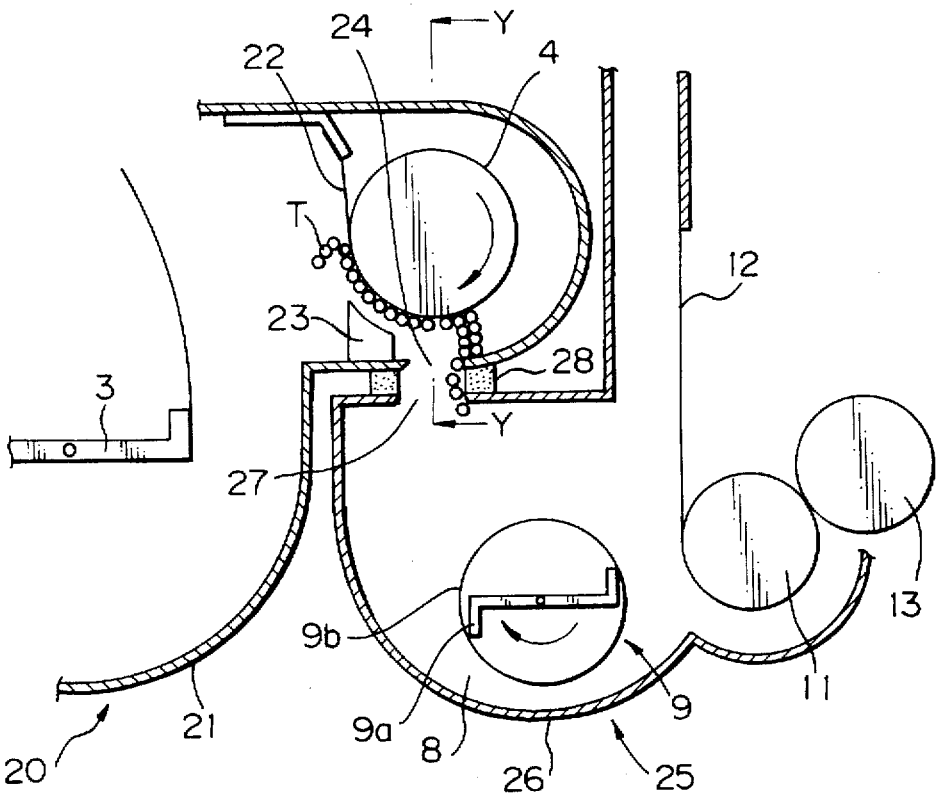
FIG. 6 is a fragmentary section of a developing device embodying the present invention and operable with a toner cartridge.

FIG. 6 shows a developing device embodying the present invention. As shown, a toner cartridge 20 has a casing 21. A blade 22 contacts the surface of a magnetic roller 4 and is made of polyethylene terephthalate (PET). Upright ribs 23 respectively extend from the casing 21 at both sides of the blade 22, and each faces the surface of the roller 4. The ribs 23 are equivalent in function to the rib 19 shown in FIG. 3. The edge of the blade 22 is oriented counter to the direction of rotation of the roller 4 and located downstream of the ribs 23 with respect to the direction of rotation of the roller 4. Collection openings 24 are formed in the casing 21, and each is flared from the inside to the outside of the casing 21.

A developing device 25 has a casing 26 formed with toner outlets 27 respectively facing the collection openings 24 of the casing 26. The toner outlets 27 are flared from the outside to the inside of the casing 26. A sponge 28 is affixed to the outer periphery of the casing 26 in such a manner as to surround the toner outlets 27 and toner inlets which will be described.

Figure 7:
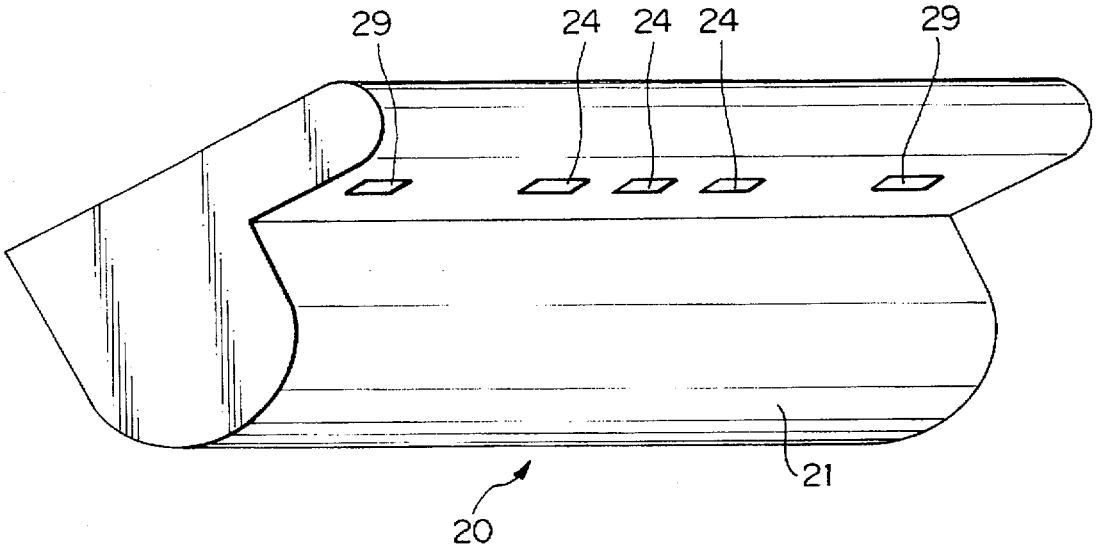
FIG. 7 is an external perspective view of the toner cartridge shown in FIG. 6.

FIG. 7 shows the toner cartridge 20 in an external perspective view. As shown, the casing 21 is formed with toner outlets 29 for replenishing a fresh toner into the developing device 25. Specifically, the toner outlets 29 are located at opposite ends of the surface of the casing 21 that faces the developing device 25 (see FIG. 6) in the lengthwise direction. The previously mentioned collection openings 24 (three in the embodiment) are formed in the intermediate portion of the above surface of the casing 21. Hence, five openings in total are formed in an array in the casing 21.

Figure 8:
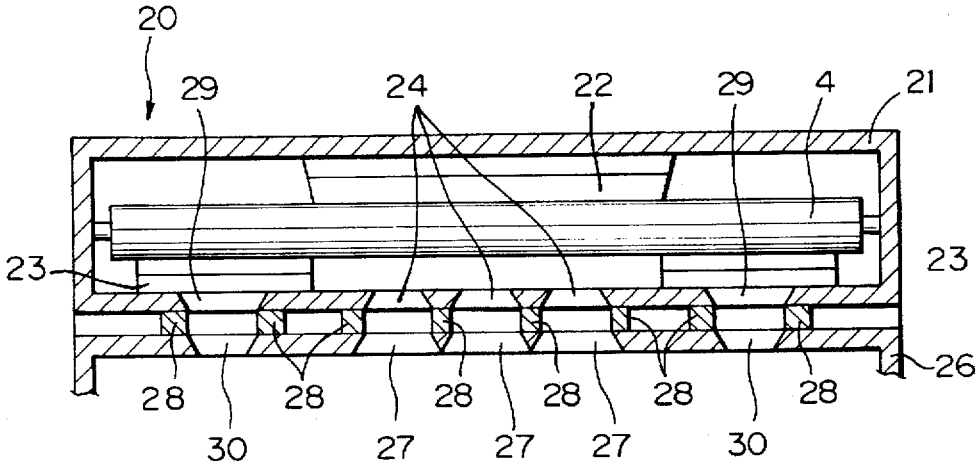
FIG. 8 is a section along line Y—Y of FIG. 6.

FIG. 8 is a section along line Y—Y of FIG. 6. As shown, toner inlets 30 are formed in the casing 26 of the developing device 25 and respectively face the toner outlets 29 of the cartridge casing 21. The toner inlets 30 are each flared from the inside to the outside of the casing 26. Specifically, two toner inlets 30 are formed in opposite end portions of the casing 26 and respectively face the toner outlets 29 of the casing 21. Three toner outlets 27 are formed in the intermediate portion of the casing 26 and respectively face the collection openings 24 of the casing 21. Hence, five openings in total are also formed in an array in the casing 26.

When the cartridge 20 is mounted to the developing device 25, the sponge 28 contacts the edge portions the toner outlets 29 and collection openings 24 and thereby fills the gaps between the edge portions of the toner outlets 29 and the toner inlets 30 and the gaps between the edge portions of the collection openings 24 and the toner outlets 27. The walls of the toner outlets 29 and those of the toner inlets 30 smoothly merge into each other without any step. Likewise, the walls of the collection openings 24 and those of the toner outlets 27 smoothly merge into each other without any step.

The ribs 23 extend from the casing 21 at the downstream side of the toner outlets 29 with respect to the direction of rotation of the roller 4 and such that their edges adjoin the opposite ends of the roller 4. Hence, a space is formed by the ribs 23, roller 4 and casing 21 at the intermediate portion of the roller 4 at the downstream side of the three collection openings 24 with respect to the direction of rotation of the roller 4.

In operation, the agitator 3 in rotation conveys the toner T to the magnetic roller 4. Because the intermediate portion of the roller 4 is covered with the blade 22, the toner T deposits on the opposite end portions of the roller 4. While the roller 4 in rotation conveys the toner T deposited on its opposite end portions, the ribs 23 scrape it off. As a result, the toner T is introduced into the hopper 8 via the aligned toner outlets 29 and toner inlets 30. The toner T is sequentially transferred to a photoconductive element, not shown, by way of an agitator 9, a developing roller 11, and an intermediate roller 13.

The agitator 9 in rotation conveys the toner upward within the hopper 8. As a result, this toner is partly collected in the cartridge 20 via the aligned toner outlets 27 and collection openings 24. Then, the toner is deposited on the roller 4, conveyed by the roller 4, and then scraped off by the blade 22 into the cartridge 20. Although the toner tends to penetrate into the collection opening side 24, such a toner is caught and conveyed by the roller 4 together with the toner collected from the hopper 8, and then scraped off by the blade 22. In this manner, the toner is circulated between the hopper 8 and the cartridge 20.

Figure 9:
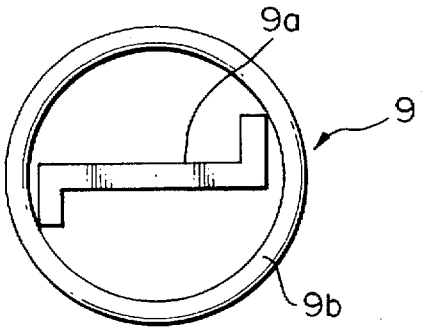
FIG. 9 is a fragmentary side elevation of an agitator representative of an alternative embodiment of the present invention.
Figure 10:
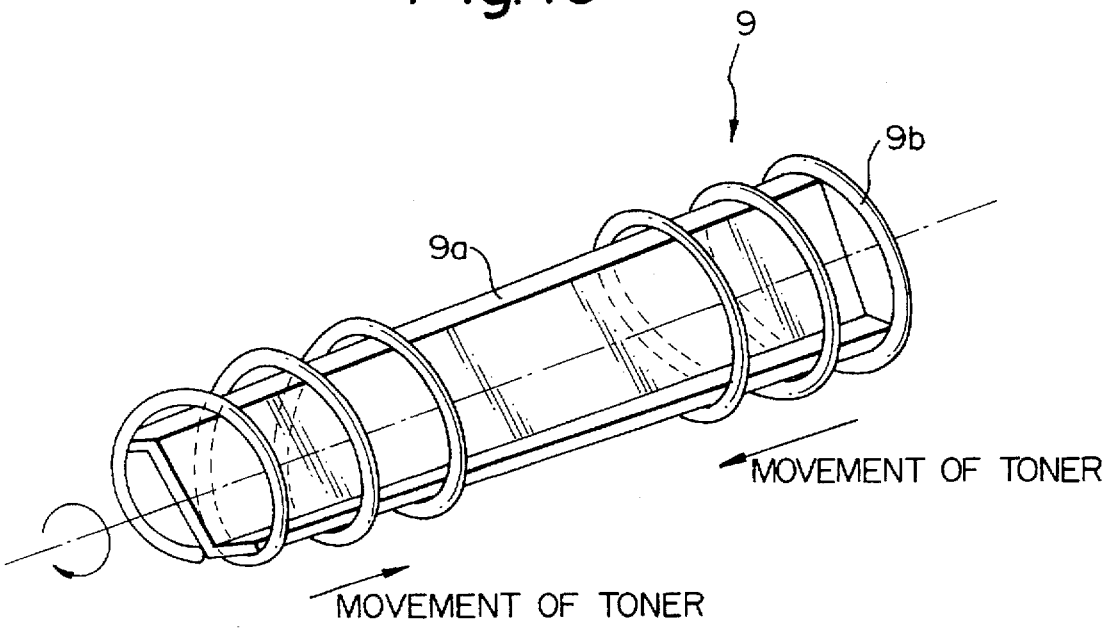
FIG. 10 is a perspective view of the agitator shown in FIG. 9.

Referring to FIGS. 9 and 10, an agitator representative of an alternative embodiment of the present invention is shown. As shown, the agitator, generally 9, has a supply roller **9*a* implemented by a sheet metal having bent portions at opposite edges thereof. An auger 9*b* is implemented as two coil members respectively wound round opposite ends of the roller 9*a*. The agitator 9 is rotatable about the longitudinal axis thereof. The bent portions of the roller 9*a* are oriented counter to the direction of rotation of the roller 9*a*. The coil members of the auger 9*b* are spirally wound round the roller 9*a* from the ends of the roller 9*a* toward the center in the same direction as the direction of rotation of the roller 9*a*. This embodiment differs from the previous embodiment in that the coil members constituting the auger 9*b* are wound round the opposite ends of the agitator 9**.

When the agitator 9 shown in FIGS. 9 and 10 is rotated, it sequentially shifts the toner from the opposite ends toward the center. Hence, the toner density is prevented from decreasing at the end portions of the developing device 25. In addition, the amount of toner increases at the intermediate portion of the hopper 8 and can enter the toner outlets 27 in a great amount.

Generally, a toner is apt to cohere and form blocks when temperature around a developing device rises. This is also true when humidity around the developing device rises. When the developing device is operated under such conditions, the toner adheres to a supply roller in a hopper such that the roller turns out a rod. If the developing device is further operated with the toner sequentially adhering thereto, the toner further solidifies due to the temperature or the humidity, aggravating the configuration of the supply roller. When the supply roller rotating at a high speed turns out a rod, it cannot seize the toner existing therearound. As a result, a space is formed between the supply roller and the neighborhood thereof. In this condition, the supply roller looses its function, and so does an auger. Consequently, the supply roller fails to shift the toner toward the center thereof.

Figure 11:
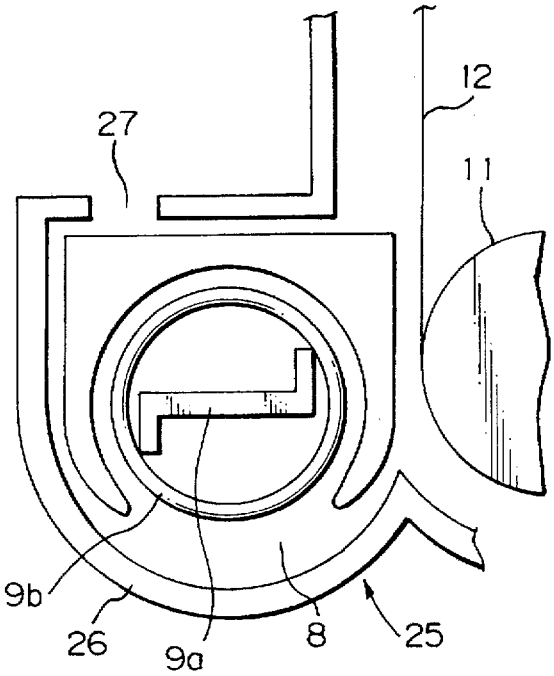
FIG. 11 is a side elevation showing how a toner adheres to a supply roller.

FIG. 11 is a section showing the supply roller turned out a rod due to the adhesion of the toner. As shown, a space is formed between the supply roller **9*a* and its neighborhood and causes the roller 9*a* to loose its expected function. Particularly, the portions of the roller 9*a* where the auger 9*b* is provided turn out a rod earlier than the other portion because the toner easily adheres to the auger 9*b***.

Figure 12:
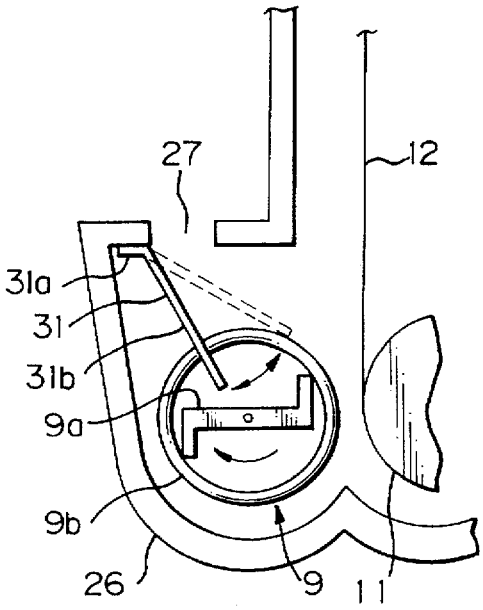
FIG. 12 is a side elevation showing an agitator representative of another alternative embodiment of the present invention, together with an arrangement around the agitator.
Figure 13:
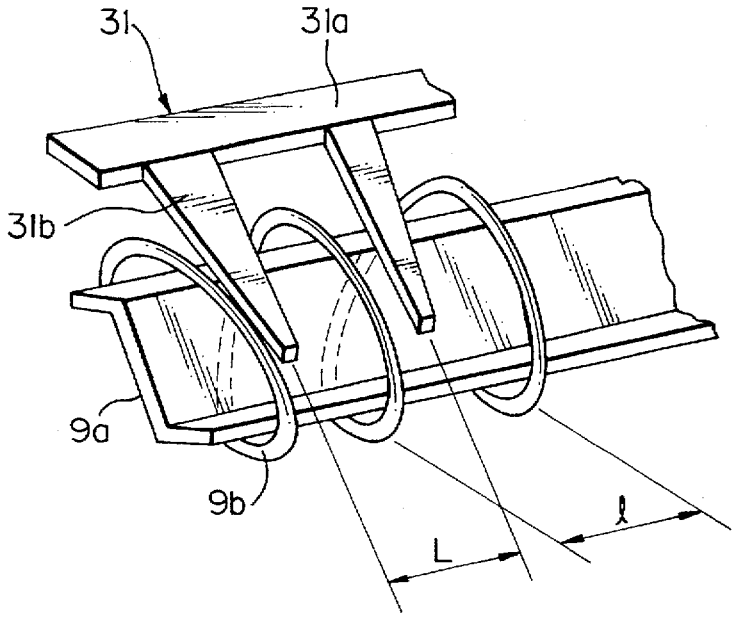
FIG. 13 is a perspective view of the agitator shown in FIG. 12 and an arrangement adjoining it.

Referring to FIGS. 12 and 13, an arrangement around an agitator and representative of another alternative embodiment of the present invention will be described. As shown, an agitator film 31 is affixed to the casing 26 at its portion **31*a* in the vicinity of the toner outlets 27. A plurality of flexible teeth 31*b* extend out from the portion 31*a* like the teeth of a comb. The tips of the teeth 31*b* are each positioned between the nearby turns of the auger 9*b* and adjoins the supply roller 9*a*. The auger 9*b* is provided with a constant pitch l. The flexible teeth 31*b* of the film 31 are provided with a pitch L equal to the pitch l of the auger 9*b*. As shown in FIG. 12, when the roller 9*a* is rotated, the teeth 31*b* are raised by the roller 9*a* or the auger 9*b*** and then lowered due to their flexibility.

With the above configuration, it is possible to agitate the toner existing between the turns of the auger **9*b* and to thereby prevent it from adhering to the roller 9*a* and auger 9*b***.

Figure 14:
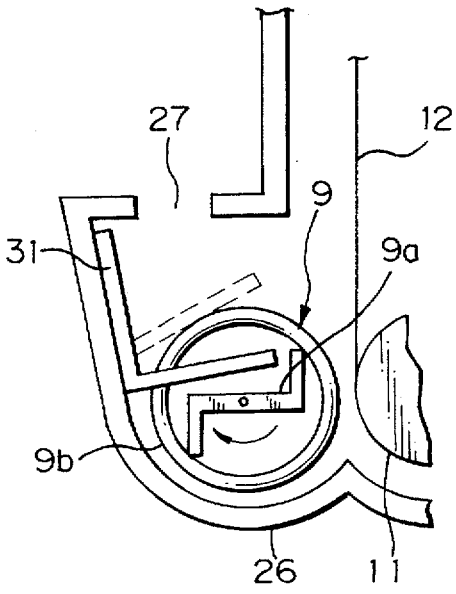
FIG. 14 is a side elevation of another specific configuration of the agitator.

While the agitator film 31 has been shown and described as being affixed to the vicinity of the toner outlets 27, they may be affixed to the inner periphery of the hopper 8, as shown in FIG. 14. The crux is that the tips of the flexible teeth **31*b* be received in the auger 9*b***.

Figure 15:
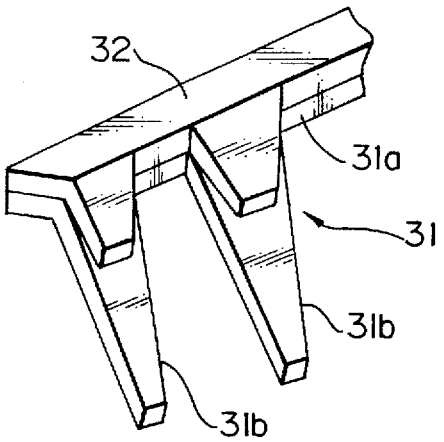
FIGS. 15 and 16 are perspective views each showing a particular configuration of an anti-deformation sheet metal attached to an agitator film.
Figure 16:
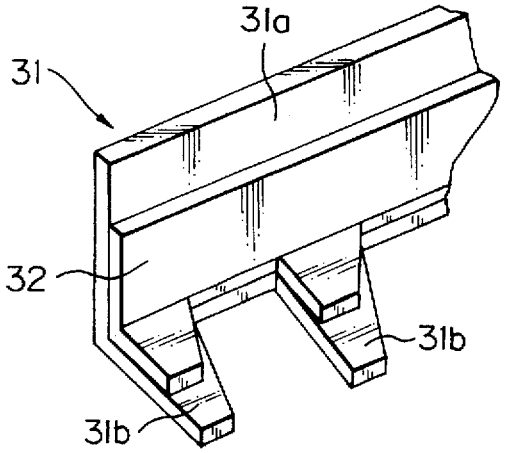

The agitator film 31 shown in FIG. 12 or 14 is likely to loose its flexibility due to aging and fail to return to the original position, i.e., to deform permanently. FIGS. 15 and 16 respectively show sheet metals 32 which may be used to prevent the films 31 shown in FIGS. 12 and 14 from bending. As shown, the sheet metals 32 of FIGS. 15 and 16 are respectively affixed to the films 31 of FIGS. 12 and 14. The sheet metals 32 each has a comb-like configuration for covering the affixing portion 31*a* of the film 31 and a part of the root portions of the teeth 31*b*.

In any of the embodiments shown and described, the toner is circulated between the cartridge 20 and the hopper 8, so that the additive of the toner existing in the developing device 25 is scattered. This prevents the additive from staying at limited portions and thereby insures stable images. Particularly, the coil members 9*b* attached to the opposite ends of the agitator 9, as shown in FIG. 10, promote the circulation of the toner and allow the toner to be rapidly fed from the end portions of the developing device 25.

Because the edges of the toner outlets 29 and toner inlets 30 and the edges of the collection openings 24 and toner outlets 27 are flared, the toner is allowed to move smoothly between the cartridge 20 and the hopper 8. The sponge 28 has both a sealing function and a guiding function. This, coupled with the fact that the walls of the openings 24 and 27 smoothly merge into each other without any step, prevents the toner from flowing reversely or from flying about, thereby further enhancing the smooth circulation of the toner.

The teeth 31*b* of the agitator film 31 positioned between the turns of the auger 9*b*, as shown in FIGS. 12 or 14, agitate the toner existing there and thereby prevent it from adhering to the supply roller 9*a* and auger 9*b*. Hence, when the supply roller 9*a* is rotated, the auger 9*b* forcibly and stably shifts the toner from the end portions of the developing device 25 toward the center. As a result, the amount of toner increases at the intermediate portion of the hopper 8 and enters the toner outlets 27 in a great amount. This promotes the circulation of the toner and allows the toner to be rapidly fed from the end portions of the hopper 8.

In summary, it will be seen that the present invention provides a developing device for an image forming apparatus and a toner cartridge having various unprecedented advantages, as enumerated below.

(1) A toner is circulated between a toner cartridge and a hopper so that the additive of the toner existing in a developing device is scattered. This prevents the additive from staying at limited portions and thereby insures stable images.

(2) Toner outlets and collection openings formed in the cartridge may be provided with a suitable arrangement, so that a path for the circulation of the toner may also be suitably arranged.

(3) The toner can be collected in the cartridge by simple means.

(4) Because the toner is replenished and collected by a magnetic roller, it is not necessary to provide the cartridge with an extra space for toner collecting means. Hence, the toner circulation is achievable with a minimum of cost.

(5) The toner is fed from opposite end portions of the hopper and then collected at the center. Hence, the toner whose additive concentration is apt to increase at the end portions of the hopper is efficiently scattered. This promotes the smooth circulation of the toner and thereby insures stable development.

(6) The movement of the hopper to the cartridge is smooth.

(7) During the circulation of the toner, the toner is prevented from dropping via gaps between the cartridge and the developing device.

(8) The cartridge has a toner replenishing function and a toner collecting function. This allows the toner to be circulated between the cartridge and the hopper. As a result, the additive included in the toner is prevented from staying in limited portions; otherwise the toner density would be lowered in the limited portions.

(9) Because a movable member is received between the turns of a coil member, the toner is prevented from cohering around the coil member. Hence, the toner is replenished and agitated in a stable manner.

(10) Because the toner is circulated between the cartridge and the hopper, the additive of the toner is prevented from staying in limited portions; otherwise the toner density would be lowered in the limited portions. The coil member surrounding a supply roller and the movable member received between the turns of the coil member achieve the above advantage (9), and further enhances the circulation of the toner.

(11) Because the coil member and the movable member have the same pitch, the toner can be efficiently agitated.

(12) A film member used as the movable member is inexpensive and can be freely designed.

(13) An anti-deformation member is associated with the film member and insures stable toner agitation and replenishment despite aging. Hence, a stable image is attainable at all times.

Various modifications will become possible for those skilled in the art after receiving the present disclosure without departing from the scope thereof. For example, the number of toner outlets and that of the collection openings of the cartridge shown and described are only illustrative. However, because the toner is replenished by being dropped and is collected by being raised, it is preferable that the number of the collection openings be equal to or greater than the number of the toner outlets.

Further, the arrangement of the toner outlets and collection openings of the cartridge and the arrangement of the blade and ribs shown and described are also only illustrative. However, because the additive concentration of the toner tends to increase at the end portions of the hopper 8 so long as the developing device is horizontal, it is preferable to feed the toner from the end portions of the hopper 8 toward the center and then collect it, as in the embodiments.

The agitator film may be replaced with a sheet metal, if desired. The crux is that portions corresponding to the flexible teeth be movable. Of course, the triangular teeth shown in FIG. 13 may be modified in various ways, e.g., they may be provided with holes or curved portions.

What is claimed is:

1. A developing device for an image forming apparatus, comprising:

a toner storing section for storing a single-ingredient type toner to be deposited on a latent image electrostatically formed on an image carrier;

agitating means for agitating the toner existing in said toner storing section; and a toner cartridge removably mounted to a body of said developing device, and storing a fresh toner to be replenished into said toner storing section;

said toner cartridge comprising toner outlets for replenishing the fresh toner, conveying means for conveying the fresh toner to said toner outlets, collection openings for receiving the toner forced out by said agitating means, and collecting means for conveying the toner received via said collection openings into said toner cartridge.

2. A device as claimed in claim 1, wherein said collecting means comprises a magnetic member.

3. A device as claimed in claim 1, wherein said toner cartridge further comprises a single magnetic roller constituting said conveying means and said collecting means, and a blade contacting a portion of said magnetic roller facing said collection openings, and for scraping off the toner entered said collection openings and the fresh toner from said magnetic roller.

4. A device as claimed in claim 1, wherein a surface of said toner cartridge facing said toner storing section is formed with said collection openings at an intermediate portion and formed with said toner outlets at opposite end portions.

5. A device as claimed in claim 4, further comprising shifting means for shifting the toner existing in said toner storing section toward said intermediate portion of said surface.

6. A device as claimed in claim 5, wherein said shifting means comprises coil members fitted on opposite end portions of said agitating means.

7. A device as claimed in claim 1, wherein said collection openings of said toner cartridge are flared from an inside to an outside of said toner cartridge.

8. A device as claimed in claim 7, further comprising a guide member intervening between said collection openings and said toner storing section, and for sealing gaps between said collection openings and said toner storing section and guiding the toner in said toner storing section to said collection openings.

9. A device as claimed in claim 1, further comprising a guide member intervening between said collection openings and said toner storing section, and for sealing gaps between said collection openings and said toner storing section and guiding the toner in said toner storing section to said collection openings.

10. A toner cartridge storing a fresh toner and removably mounted to a body of a developing device for replenishing the fresh toner into a toner storing section included in said developing device, said toner cartridge comprising:

toner outlets for replenishing the fresh toner;

collection openings for receiving a part of a toner existing in the toner storing section;

a magnetic roller extending in a longitudinal direction of a body of said toner cartridge, and facing said toner outlets and said collection openings; and a blade contacting a portion of said magnetic roller facing said collection openings, and for scraping off the fresh toner and the toner collected via said collection openings from said magnetic roller.

11. A developing device for an image forming apparatus, comprising:

a toner storing section for storing a single-ingredient type toner;

conveying means for causing the toner in said toner storing section to deposit on a surface thereof, and causing said toner to be transferred to a latent image electrostatically formed on an image carrier;

a supply roller rotatably disposed in said toner storing section, and for driving the toner in said toner storing section toward said conveying means;

a coil member fitted on said supply roller, and for shifting the toner in an axial direction of said supply roller; and a movable member having a stationary end affixed to a predetermined position of a body of said developing device and free ends received between nearby turns of said coil member, said free ends being movable up and down in association with a rotary motion of said supply roller.

12. A device as claimed in claim 11, wherein said free ends of said movable member have a same pitch as said coil member.

13. A device as claimed in claim 12, wherein said movable member comprises a film.

14. A device as claimed in claim 13, further comprising anti-deformation means for preventing said film from being deformed.

15. A device as claimed in claim 11, wherein said movable member comprises a film.

16. A device as claimed in claim 15, further comprising an anti-deformation means for preventing said film from being deformed.

17. A developing device for an image forming apparatus, comprising:

a toner storing section for storing a single-ingredient type toner;

conveying means for causing the toner in said toner storing section to deposit thereon, and causing said toner to be transferred to a latent image electrostatically formed on an image carrier;

a supply roller rotatably disposed in said toner storing section, and for driving the toner in said toner storing section toward said conveying means while agitating said toner;

a toner cartridge removably mounted to a body of said developing device, and storing a fresh toner to be replenished into said toner storing section, said toner cartridge comprising toner outlets for replenishing the fresh toner, conveying means for conveying the fresh toner to said toner outlets, collection openings for receiving the toner forced out by said supply roller, and collecting means for conveying the toner received via said collection openings into said toner cartridge;

a coil member fitted on said supply roller for shifting the toner in an axial direction of said supply roller; and a movable member having a stationary end affixed to a predetermined position of a body of said developing device and free ends received between nearby turns of said coil member, said free ends being movable up and down in association with a rotary motion of said supply roller.

18. A device as claimed in claim 17, wherein said free ends of said movable member have a same pitch as said coil member.

19. A device as claimed in claim 18, wherein said movable member comprises a film.

20. A device as claimed in claim 19, further comprising anti-deformation means for preventing said film from being deformed.

21. A device as claimed in claim 17, wherein said movable member comprises a film.

22. A device as claimed in claim 21, further comprising an anti-deformation means for preventing said film from being deformed.

23. A toner cartridge storing a fresh toner and removably mountable to a developing device having a toner storing section for replenishing toner in the toner storing section, comprising:

a casing in which toner is stored; and a plurality of openings in said casing through which toner may flow when the toner cartridge is mounted to a developing device, wherein a width of at least one of said openings decreases from an inside toward an outside of said casing and wherein a width of at least another one of said openings increases from the inside toward the outside of said casing.

24. The toner cartridge of claim 23 wherein said openings are tapered.

25. A toner cartridge storing a fresh toner and removably mountable to a developing device having a toner storing section for replenishing toner in the toner storing section, comprising:

a casing in which toner is stored;

a plurality of openings in said casing;

an elongated member rotatably mounted in said casing at a position to feed toner in said casing to at least one of said openings for discharging the toner to the developing device when said elongated member is rotated; and an element in said casing engaging a portion of said elongated member to remove toner therefrom such that toner is not discharged from at least another one of said openings.

26. The toner cartridge of claim 25, further comprising a rib in said casing and cooperating with said elongated member to limit a quantity of toner discharged through said at least one of said openings.

27. The toner cartridge of claim 26 wherein said rib and said elongated member form a gap to limit the quantity of toner discharged through said at least one of said openings.

28. The toner cartridge of claim 25 wherein said at least one of said openings is tapered such that a width thereof decreases from an inside toward an outside of said casing and wherein said at least another one of said openings is tapered such that a width thereof increases from the inside toward the outside of said casing.

29. The toner cartridge of claim 25 wherein said elongated member is a magnetic member.

30. The toner cartridge of claim 29 wherein said element engaging a portion of said elongated member comprises a scraper.

31. The toner cartridge of claim 25 wherein said element engaging a portion of said elongated member comprises a scraper.

32. A developing device for an image forming apparatus, comprising:

a toner storing section having a plurality of openings through which toner may flow; and a toner cartridge storing a fresh toner and removably mountable to the developing device, said toner cartridge comprising:

a casing in which toner is stored, and a plurality of openings in said casing through which toner may flow to or from said openings of said toner storing section when said toner cartridge is mounted to the developing device, wherein a width of at least one of said openings decreases from an inside toward an outside of said casing and wherein a width of at least another one of said openings increases from the inside toward the outside of said casing.

33. The toner cartridge of claim 32 wherein said openings are tapered.

34. A developing device for an image forming apparatus, comprising:

a toner storing section having a plurality of openings through which toner may flow; and a toner cartridge storing a fresh toner and removably mountable to the developing device, said toner cartridge comprising:

a casing in which toner is stored, a plurality of openings in said casing through which toner may flow to or from said openings of said toner storing section when said toner cartridge is mounted to the developing device, an elongated member rotatably mounted in said casing at a position to feed toner in said casing to at least one of said openings of said casing for discharging the toner to at least one of the openings of said toner storing section when said elongated member is rotated, and a member in said casing engaging a portion of said elongated member to remove toner therefrom such that toner is not discharged from at least another one of said openings of said casing.

35. The developing device of claim 34, further comprising a rib in said casing and cooperating with said elongated member to limit a quantity of toner discharged through said at least one of said openings of said casing.

36. The developing device of claim 35 wherein said rib and said elongated member form a gap to limit the quantity of toner discharged through said at least one of said openings.

37. The developing device of claim 34 wherein said at least one of said openings of said casing is tapered such that a width thereof decreases from an inside toward an outside of said casing and wherein said at least another one of said openings of said casing is tapered such that a width thereof increases from the inside toward the outside of said casing.

38. The toner cartridge of claim 34 wherein said elongated member is a magnetic member.

39. The toner cartridge of claim 38 wherein said member in said casing engaging a portion of said elongated member comprises a scraper.

40. The toner cartridge of claim 34 wherein said member in said casing engaging a portion of said elongated member comprises a scraper.

* * * * *